US006749282B2

(12) United States Patent
Kohno

(10) Patent No.: US 6,749,282 B2
(45) Date of Patent: Jun. 15, 2004

(54) PRINTING APPARATUS AND PRINTING SYSTEM

(75) Inventor: Tetsushi Kohno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/789,640

(22) Filed: Feb. 22, 2001

(65) Prior Publication Data

US 2001/0024287 A1 Sep. 27, 2001

(30) Foreign Application Priority Data

Feb. 24, 2000 (JP) ..... 2000-048327

(51) Int. Cl.[7] ..... B41J 2/165
(52) U.S. Cl. ..... 347/23
(58) Field of Search ..... 347/23, 22, 35, 347/30, 29, 14

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 6,086,180 A | * | 7/2000 | Sugimoto et al. | 347/14 |

FOREIGN PATENT DOCUMENTS

| | | | | |
|---|---|---|---|---|
| EP | 0 442 470 A2 | * | 8/1991 | B41J/2/165 |
| EP | 0 540 174 A1 | * | 5/1993 | B41J/2/165 |
| JP | 54-56847 | | 5/1979 | |
| JP | 59-123670 | | 7/1984 | |
| JP | 59-138461 | | 8/1984 | |
| JP | 60-71260 | | 4/1985 | |
| JP | 1-306271 A | * | 12/1989 | B41J/29/20 |
| JP | 7-52409 | | 2/1995 | |
| JP | 7-219653 | * | 8/1995 | G05F/1/00 |
| JP | 9-240015 | | 9/1997 | |

* cited by examiner

*Primary Examiner*—Hai Pham
(74) *Attorney, Agent, or Firm*—Fitzpatrick, Cella, Harper & Scinto

(57) ABSTRACT

In an inkjet printer having primary power-turn-on means for physically supplying power to the printer and secondary power-turn-on means for bringing the printer into a state where functions are enabled, ink consumption due to a suction recovery processing is reduced. The number of times that the secondary power supply is on is counted. The count value is stored in a non-volatile memory. It is judged whether the count value is above a predetermined value when the secondary power supply becomes on, if yes, the recovery processing is executed. The count value and the contents of the memory are then cleared. The counting is prohibited till primary power supply is off. As the above contents is retained even after the primary power supply is off, necessity of recovery processing when the secondary power supply becomes on is judged based on the state before the primary power supply was off.

14 Claims, 7 Drawing Sheets

PRINTING APPARATUS AND PRINTING SYSTEM

This application is based on Patent Application No. 2000-48327 filed Feb. 24, 2000 in Japan, the content of which is incorporated hereinto by reference.

BACKGROUND OF THE INVENTION

1. Field of the Invention

The present invention relates to a printing apparatus, and is particularly preferable for maintenance of a printing head used on an inkjet printing apparatus and for performing a printing on a printing medium by ejecting ink.

2. Description of the Prior Art

A printing apparatus is known that comprises a primary power-turn-on means for bringing a state to physically supply electric power to the apparatus (that is, a hardware-power-on state) and a secondary power-turn-on means for bringing the printing apparatus into a state where functions thereof are executable (that is, a software-power-on state).

In an inkjet type printing apparatus for printing on a printing medium by using a printing head (i.e., an inkjet head) for ejecting ink, provided is recovery processing means for forcedly ejecting ink through an ink ejection opening in order to eliminate clog and so on causing an ejection failure or non-ejection state at the ink ejection opening provided at the printing head and to maintain favorable ejection performance. This recovery processing means has, for example, a cap member for capping a face on which ejection openings are formed of the inkjet head (the face will be referred as 'the ejection opening forming face', hereinafter), suction means for suctioning the inside of the cap and a member for wiping the ejection opening forming face.

In the above-mentioned inkjet printing apparatus, when the software-power-on state is brought about for the first time after the hardware-power-on state, in the accompanying software-power-on processing, a recovery processing as a maintenance action for the inkjet head, that is, recovery processing through suctioning is executed unconditionally. This means that suction recovery processing of the inkjet head is always executed when the hardware power supply is turned on, because the maintenance state of the inkjet head is not known when it was executed before the hard power supply was off previously.

The recovery processing for forcedly ejecting ink from the inkjet head by means such as suction is an indispensable processing for eliminating ejection failure of the inkjet head due to clog or the like at the ink ejection opening and for maintaining ejection performance. However, there is a problem that ink consumption is increased by the recovery processing.

SUMMARY OF THE INVENTION

It is an object of the present invention to recognize a state before the hardware power supply was turned off the last time and to reflect the recognition in a software-power-on processing at the present time.

It is another object of the present invention, in the inkjet type printing apparatus for printing on a printing medium using an inkjet head, to maintain ejection quality of the inkjet head while effectively suppressing increase in ink consumption through recovery processing of the inkjet head by judging necessity of maintenance processing of the inkjet head when the software power supply is on, based on the maintenance state of the inkjet head before the hardware power supply was off last.

In a first aspect of the present invention, there is provided a printing apparatus for performing printing on a printing medium by using a printing head, comprising:

- means for turning on/off a secondary power supply to bring the apparatus into a state in which a function is executable after a primary power source for physically supplying power to the apparatus is turned on;
- means for counting the number of times that the secondary power supply is turned on; and
- means for holding the count value even in a state where the primary power supply is turned off.

In a second aspect of the present invention, there is provided a printing apparatus for performing printing on a printing medium by using a printing head, comprising:

- means for switching between a state in which operation of the apparatus is made possible and a state in which operation of the apparatus is not made possible, in a state where power is supplied to the apparatus;
- means for counting the number of times that operation of the apparatus is made possible by the switching means; and
- means for holding a count value of the counting means even in a state where power is not supplied to the printing apparatus.

In a third aspect of the present invention, there is provided a printing system comprising a printing apparatus for performing printing on a printing medium by using a printing head and an image data supplying apparatus for supplying an image data to be printed to the printing apparatus, the system comprising:

- means for turning on/off a secondary power supply to bring the apparatus into a state in which a function is executable after a primary power source for physically supplying power to the apparatus is turned on;
- means for counting the number of times that the secondary power supply is turned on; and
- means for holding the count value even in a state where the primary power supply is turned off.

In a fourth aspect of the present invention, there is provided printing system comprising a printing apparatus for performing printing on a printing medium by using a printing head and an image data supplying apparatus for supplying an image data to be printed to the printing apparatus, the system comprising:

- means for switching between a state in which operation of the printing apparatus is made possible and a state in which operation of the printing apparatus is not made possible, in a state where power is supplied to the printing apparatus;
- means for counting the number of times that operation of the printing apparatus is made possible by the switching means; and
- means for holding a count value of the counting means even in a state where power is not supplied to the printing apparatus.

According to the present invention, by providing counter means for counting the number of times when the secondary power supply (software power supply) is turned on and means for maintaining the count value even during the state where the primary power supply (hardware power supply) is off or power supply to the apparatus is stopped, the apparatus state till the hardware power supply was turned off last is reflected in the processing of the software power supply at the present time.

In the case that the present invention is applied to the inkjet type printing apparatus, it is judged whether or not the count value is more than or equal to a predetermined value when the software power supply is on, and if an affirmative judgement is made, recovery processing of the inkjet head, for example, recovery processing by ink suction through an ejection opening is executed. Further, there is provided a function to clear the count value and storage contents of storing means when the recovery processing is executed and to prevent the count till the hardware power supply is turned off.

That is, when the software power supply is on after the hardware power supply was turned on, only for the first time when it is judged that the count value for counting the times of software-power-on without recovery operation of the inkjet head becomes more than or equal to a predetermined number, the recovery operation is executed. When the recovery operation is executed, the count value is cleared and the count value is not renewed till the hardware power supply is turned of f even if the software power supply is turned on/off. Also, as the count value is maintained in a non-volatile memory and the contents thereof are retained even during the hardware power supply is turned off. Therefore, increase in ink consumption due to recovery processing of the inkjet head is properly suppressed while maintaining ejection quality of the inkjet head, by judging necessity of maintenance processing of the inkjet head when the software power supply is turned on based on the maintenance state of the inkjet head before the hardware power supply was turned off.

In this specification, a word "image" means the concept covering characters such as letters, numbers, symbols, etc. as well as images of patterns, pictures, photos, etc. in a narrow sense and also includes mixture of them.

A word "print" refers to not only forming significant information, such as characters and figures, but also forming images, designs or patterns on printing medium and processing media, whether the information is significant or insignificant or whether it is visible so as to be perceived by humans.

The term "printing medium" include not only paper used in common printing apparatus, but cloth, plastic films, metal plates, glass, ceramics, wood, leather or any other material that can receive ink.

Further, the word "ink" should be interpreted in its wide sense as with the word "print" and refers to liquid that is applied to the printing medium to form images, designs or patterns, process the printing medium or process ink.

The above and other objects, features and advantages of the present invention will become more apparent from the following description of embodiments thereof taken in conjunction with the accompanying drawings.

DETAILED DESCRIPTION OF THE PREFERRED EMBODIMENTS

An Example of a Printing Apparatus

Figure 1:
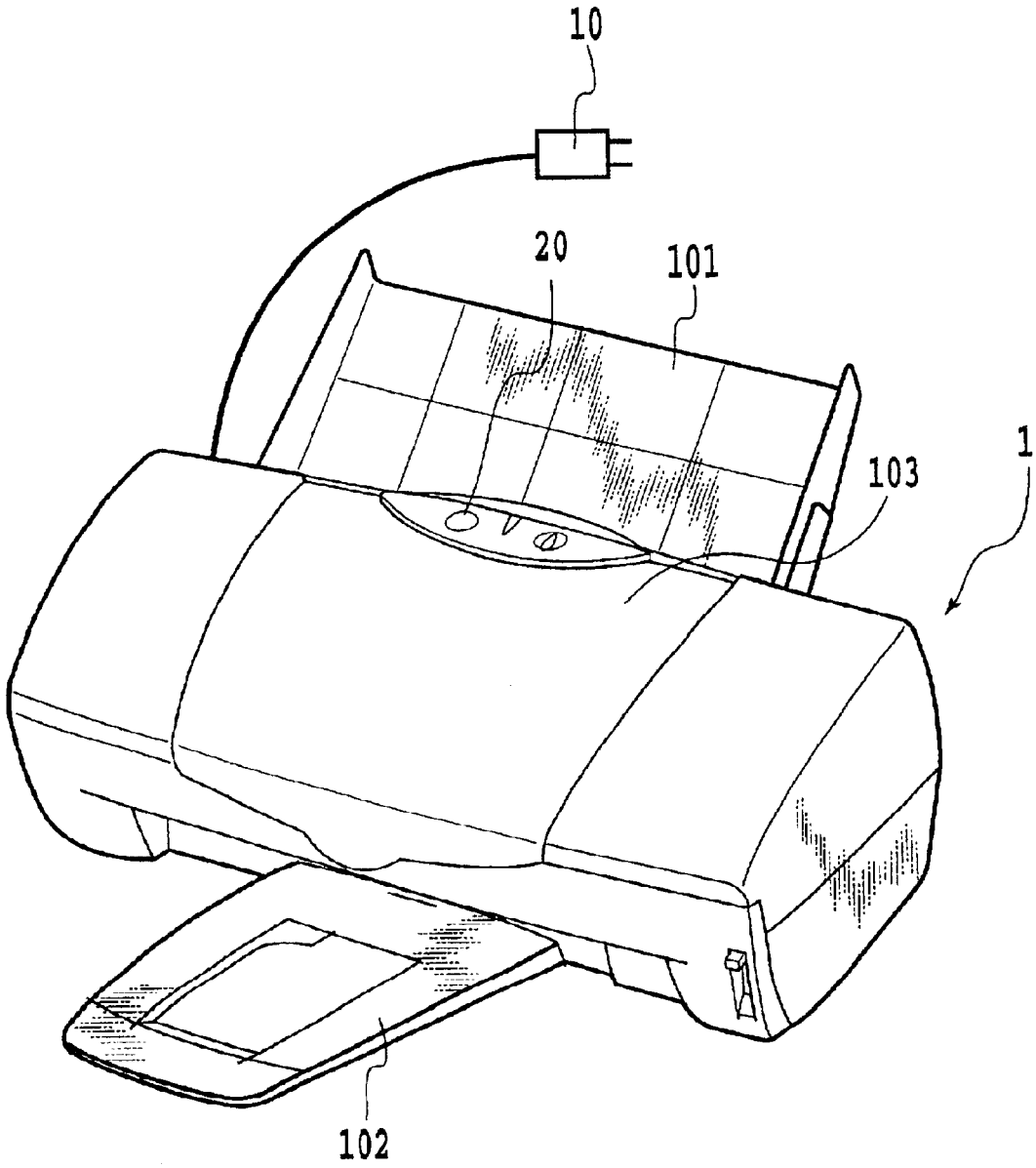
FIG. 1 is a perspective view showing a configuration of an inkjet printing apparatus as an example of the printing apparatus to which the present invention is preferably embodied or applied.

FIG. 1 is a perspective view showing a configuration of an inkjet printing apparatus as an example of the printing apparatus to which the present invention is preferably embodied or applied.

In FIG. 1, a printing apparatus shown by the reference numeral 1 is provided with a primary power-turn-on part 10 to bring a state where electric power is physically supplied to the apparatus (hardware-power-on state) and a secondary power-turn-on switch 20 to bring the printing apparatus into a state in which functions can be executable (software-power-on state). Reference numeral 101 denotes a paper feed tray on which printing media to be used for print processing are piled, while reference numeral 102 denotes a paper eject tray for piling printing media after printing. Denoted 103 is a front cover for opening the apparatus.

In the example shown in FIG. 1, the primary power power-turn-on part 10 serves as a connection part for receiving supply of electric power and brings the apparatus to the state where power is supplied from the outside by being connected to a power supply source such as a home power supply outside the apparatus. Also, the switch 20 shown in FIG. 1 switches between the state where the apparatus is operable and the state where the apparatus is not operable, when power is supplied to the apparatus by the primary power-turn-on part 10. Thus, the printing apparatus shown in FIG. 1 is brought to the hardware-power-on state by being connected to a power source such as home power supply and is switched to the software-power-on or -off state by operating the switch 20.

Figure 2A:
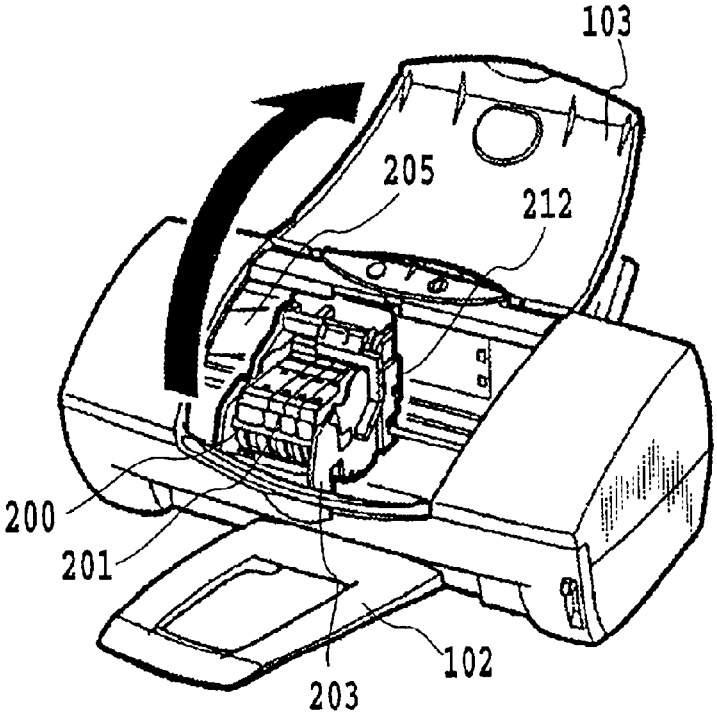
FIG. 2A is a perspective view showing the state where a part of the inside of the apparatus is exposed by opening a front cover of the apparatus in FIG. 1.
Figure 2B:
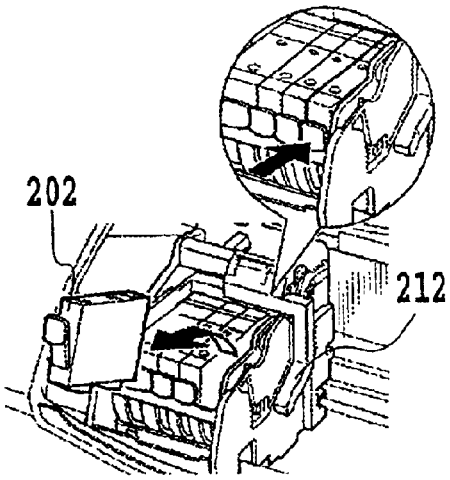
FIG. 2B is an explanatory view for explaining exchange of an ink tank in the exposed state.
Figure 2C:
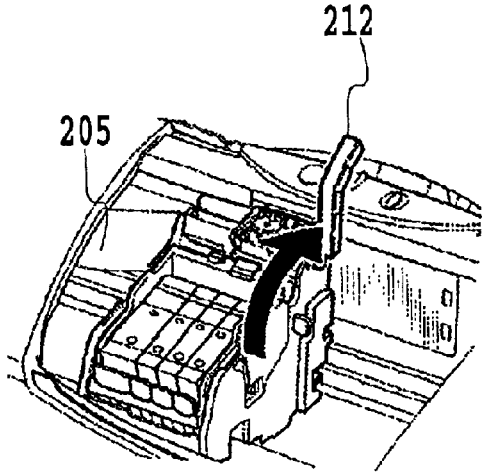
FIG. 2C is an explanatory view for explaining exchange of a head cartridge.

FIGS. 2A to 2C show a state where a part of the inside of the apparatus is exposed by opening the front cover 103. The front cover 103 may take any form which can expose a necessary part of the apparatus for ink tank exchange or other jobs. For instance, the front cover 103 may be rotatably attached to the body by a hinge or the like in the direction of the arrow in FIG. 2A or may be completely separable from the body of the printing apparatus 1.

In these figures, reference numeral 201 denotes a head cartridge. Denoted 203 is a carriage having a cartridge holder as a member for removably holding the head cartridge 201. Denoted 212 is a lever to fix the head cartridge 201 to the carriage 203. When the lever 212 is manipulated after the head cartridge 201 is attached to the carriage 203, the head cartridge 201 is pressed onto carriage 203. By this pressing, the head cartridge 201 is positioned and an electric contact on the head cartridge 201 is in contact with a required electric contact provided at the carriage 203 for signal transmission. Denoted 205 is a flexible cable for transmitting electric signals to the carriage 203.

The head cartridge 201 used in this example holds an ejection portion as a main body of an inkjet head and also removably holds an ink tank 202 for storing ink to be supplied to the ejection portion. That is, when the residual quantity of the ink tank runs short or zero, the ink tank can be separately exchanged.

In the printing apparatus of this preferred embodiment, an ink tank or a head cartridge is exchanged in a head cartridge/ink tank exchange mode set by opening the front cover 103. That is, when the front cover 103 is opened, the carriage 203 removably holding the head cartridge 201 is moved to the exchange position shown in FIG. 2A, where the ink tank 202 (FIG. 2B) or the head cartridge 201 (FIG. 2C) can be exchanged.

In the case that the ink tank 202 is exchanged, when the front cover 103 is closed and the head cartridge/ink tank exchange mode is to be finished, the exchange of the ink tank 202 may be judged by reading the ink storage state in the ink tank by using, for example, an optical sensor and comparing the ink storage states when the cover is opened and closed. Also, the exchange of the head cartridge may be judged based upon a signal level at the electric contact parts of the carriage 203 and the head cartridge 201.

Figure 3:
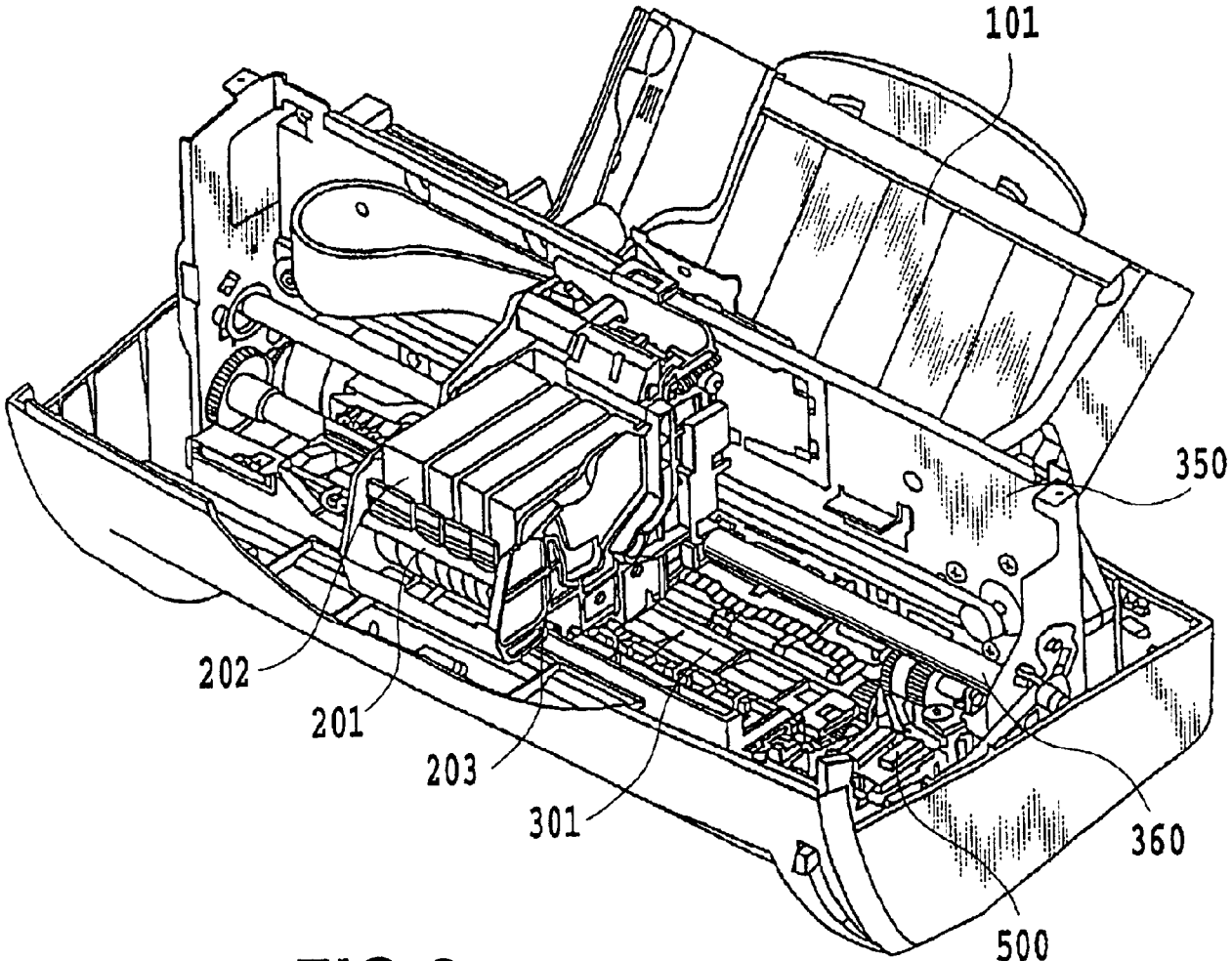
FIG. 3 is a perspective view showing the state where the whole inside of the apparatus is exposed by removing the entire upper cover of the apparatus in FIG. 1.

FIG. 3 shows a state where the entire upper cover of the apparatus is removed and the whole inside of the apparatus is exposed.

A sheet-like printing medium set on the paper feed tray 101 is fed by a feed roller and conveyed (sub-scan) over a platen 301 by a conveyer roller. The carriage 203 is supported in capable of movement (main scan) over a scan rail 360, and a printing is executed by driving the inkjet head to eject ink during the process of movement.

Denoted 500 is a recovery system and comprises, for example, a cap member for capping an ejection opening forming face of the inkjet head, suction means such as a pump for suctioning inside this cap, and a member for wiping the face ejection opening forming. When a driving source for driving these members are used also as a driving source (e.g., motor) for conveying a printing medium, an appropriate driving switching unit may be provided at the recovery system 500. Denoted 350 is a chassis for supporting each of the above members.

The head cartridge 200 in this example is to hold four ejection portions in total, each of which corresponds to monochrome ink (black, for example) or color ink (cyan, magenta and yellow) and permits each of the ink tanks 202 storing ink to be supplied to each of the ejection portions to attach/remove. However, the form of the head cartridge and the form of attachment are not limited to the examples shown in FIG. 3. That is, besides this example in which each corresponds to a single-color ink, those integrally supporting an ink tank corresponding to plural ink types with different tone (color, density, etc.) and ejection portion may be used. A plurality of head cartridges corresponding to a single-color or plural-colors may be provided corresponding to different print density. Also, the head cartridge corresponding to the purpose may be selectively attached to the carriage 203 according to the object of the print such as binary images, half tone images or photo tone images.

Moreover, the ink ejection portion may have a construction inseparable from the ink tank, or may be supplied with ink through a tube or the like from the ink tank provided at a separate location of the apparatus.

Also, each of the ejection portions may have a number of ink ejection openings arranged thereon, liquid passages each of which communicates to each of the ink ejection openings and electrothermal transducers (ejection heaters) each of which is provided at the liquid passage to generate thermal energy according to electricity for causing film boiling in the ink as an energy to be used for ejecting ink.

An Example of a Control System of the Printing Apparatus

Figure 4:
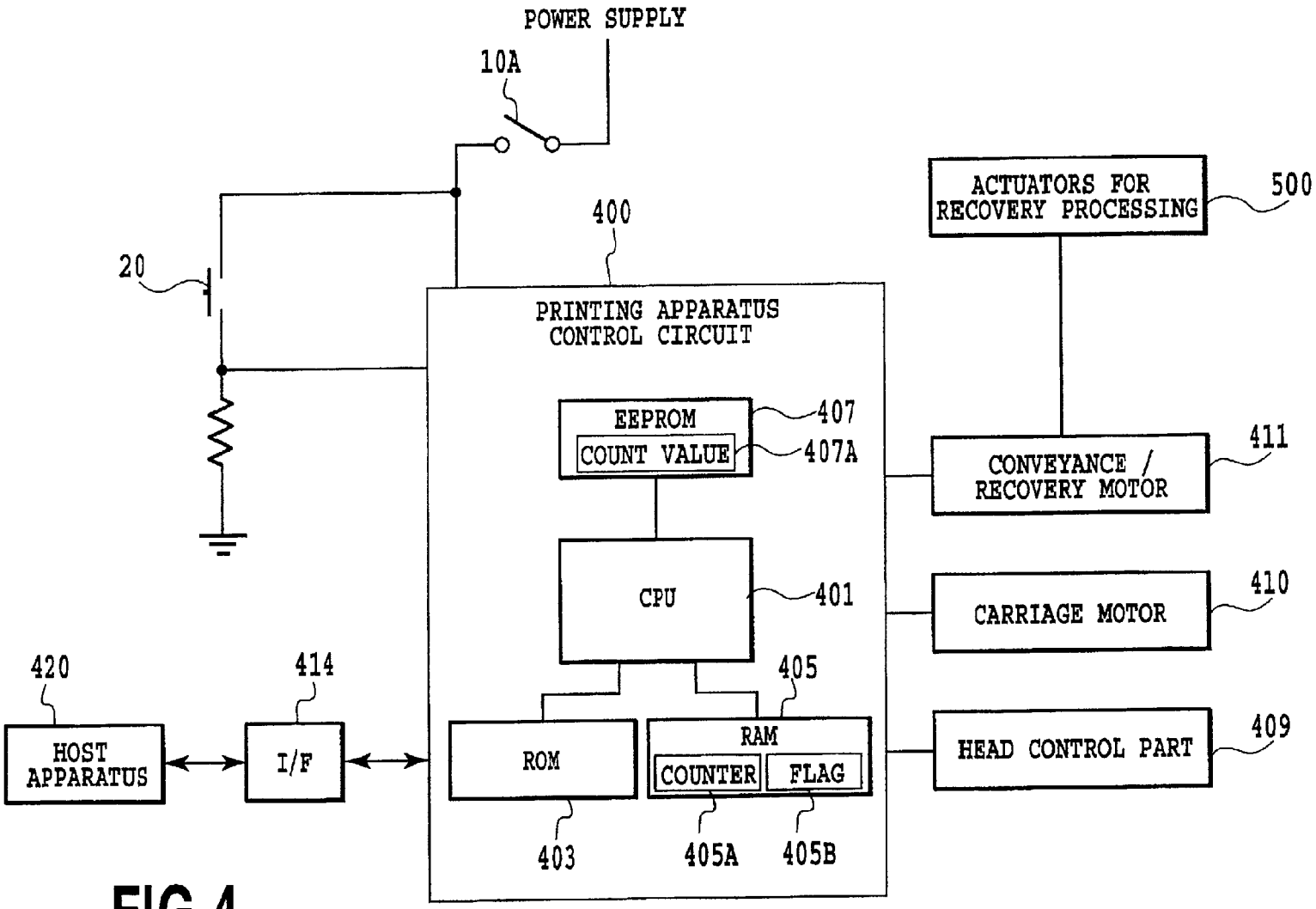
FIG. 4 is a block diagram showing a configuration of a control system of the printing apparatus shown in FIGS. 1 to 3.

FIG. 4 is a block diagram showing a schematic constructional example of a control system of the above-mentioned printing apparatus.

The printing apparatus of this embodiment has two power supply layers, one of which is a primary power supply part (including a primary power switch 10A interposed between power lines) for supplying electric power to a control circuit 400 of the printing apparatus to function the control circuit and the other is a secondary power switch 20 to bring the state where the printing apparatus is enabled to operate.

The control circuit 400 has in general CPU 401, ROM 403, RAM 405 and EEPROM 407. Here, the CPU 401 may take the form of a microcomputer. The CPU 401 generates print data in the printing apparatus, analyzes various commands, performs various settings, and controls main scan and sub-scan, etc. Further, the CPU 401 executes processing procedures which will be described later referring to FIGS. 5 to 7. The ROM 403 stores programs corresponding to these processing procedures, required tables and other fixed data.

The RAM 405 has an area to be used for expanding print data, an area for temporarily storing various setting information, an area to be used for processing of print data, when necessary, and an area for temporarily storing data and commands put into an interface (I/F) 104 and data and commands put out of an interface 414. In this example, particularly, the RAM 405 is provided with a counter area 405A for counting the number of times that the recovery processing has not been executed even when the software power supply is turned on through manipulation of the secondary power switch 20, and a flag area 405B (software-power-on recovery flag) showing whether the recovery processing has been done at the first software-power-on after the latest primary power supply ON. The EEPROM 407 is a non-volatile memory having an area 407A for holding the count value of the counter area 405A of the RAM 405 even when the primary power supply is OFF.

Reference numeral 409 denotes a head control part for driving ejection heaters of the inkjet head according to the print data and so on. Denoted 410 is a carriage motor as a driving source for reciprocally moving the carriage 203 in the main-scan direction. Denoted 411 is a conveyer/recovery motor as a driving source for conveying the printing medium in the sub-scan direction, and as a driving source for actuators (suction pump, cap movement mechanism, blade movement mechanism, etc.) of a recovery system 500. These are operated under the control of the CPU 401. When it is judged as necessary when the secondary power source is on, the driving force of the motor 411 is transmitted to the actuators of the recovery system 500 for operation, and the suction recovery operation of the inkjet head is executed.

Denoted 420 is a host apparatus connected through the interface 414. The host apparatus 420 may be a computer for generating data of images to be printed by the printing apparatus and for processing and editing the data, etc. This host apparatus 420 may take the form of a digital camera.

Control Procedures

A detailed processing example of the printing apparatus according to the preferred embodiment will be explained using FIGS. 5 to 7.

Figure 5:
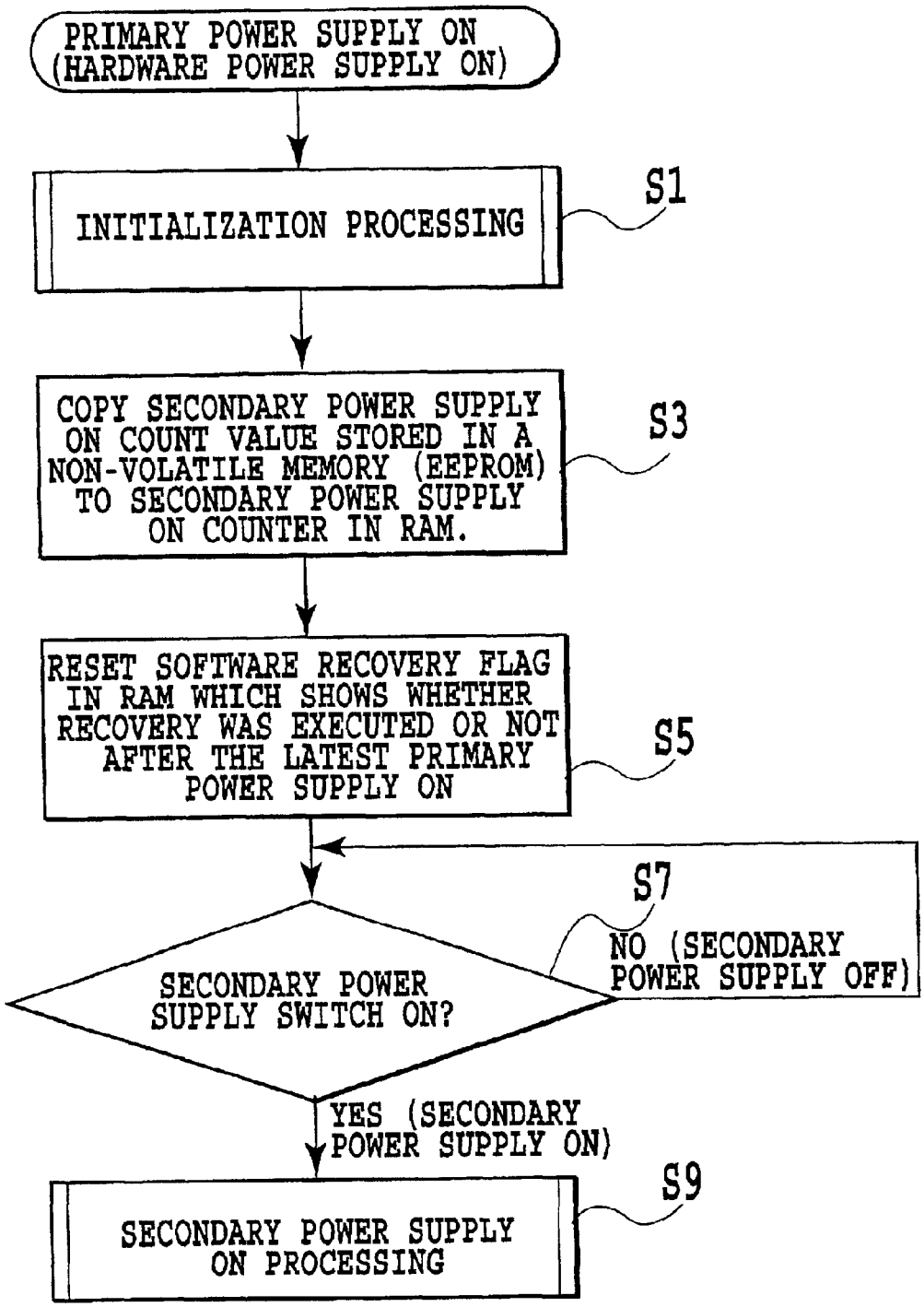
FIG. 5 is a flowchart showing an example of processing procedures of the printing apparatus when the primary power supply is turned on according to the preferred embodiment of the present invention.

FIG. 5 is a flowchart showing an example of the processing procedure activated when the primary power is turned on.

When the primary power source is turned on by connecting the primary power 10 to the power supply source or operating the switch 10A, electric power is supplied to the control circuit 400 and a control program corresponding to the procedure in FIG. 5 stored in the ROM 403 is started. When this program is started, initialization processing such as setting of the hardware is executed (Step S1). Then, a count value held within the EEPROM 407 which is a non-volatile memory, that is, the number of times that the recovery processing has not been executed even after the software power supply was turned on by operation of the secondary power switch 20 is copied to the counter area 405A in the RAM 405 which is a temporary stored memory to be used during the process of print control (Step S3). And then, the software-power-on recovery flag 405B provided in the predetermined area in the RAM 405, that is, the flag showing whether the recovery processing was executed or not after the latest primary power supply ON is reset (Step S5). After that, turning on of the secondary power source by operating of the secondary power switch 20 is waited for (Step S7), and the program moves on to the secondary power supply ON processing according to the operation (Step S9). When the secondary power supply is turned off during the primary power supply is on, turning-on of the secondary power supply is waited for at the Step S7.

Figure 6:
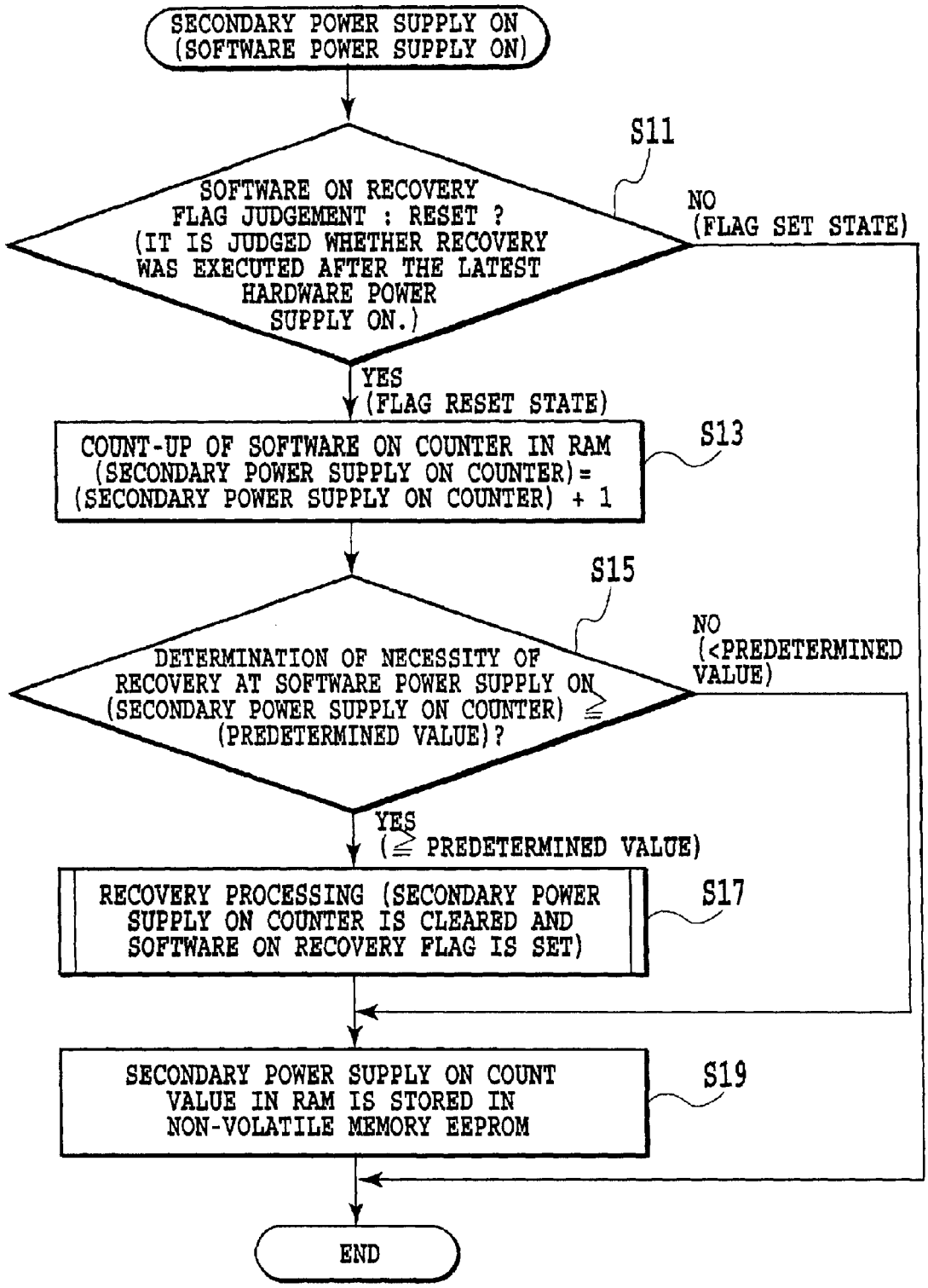
FIG. 6 is a flowchart showing an example of processing procedures of the printing apparatus when the secondary power supply is turned on according to the preferred embodiment of the present invention.

FIG. 6 is a flowchart showing an example of the processing procedures executed when the secondary power supply is turned on.

When the secondary power supply is turned on by operation of the secondary power switch 20, the contents of the software-power-on recovery flag 405B showing whether the recovery processing was executed after the latest primary power supply ON is judged (Step S11). If it is judged that this flag was reset, that is, no recovery processing has been done after the latest primary power supply ON, the counter 405A in the RAM 405 storing the number of times that the recovery processing was not executed even after the software power supply is turned on by operating the secondary power switch 20 is incremented by +1 (Step S13). If the software-power-on recovery flag 405B has not been reset, that is, there has been a recovery processing, the secondary power supply ON processing is completed.

After the counter 405A is counted up by +1, it is judged whether the count value is more than or equal to the predetermined value or not (Step S15), and if yes, it is judged that the recovery processing is required and the recovery processing is executed (Step S17). And after the recovery processing has been executed, or when it is judged that the count value is less than the predetermined value, the value of the counter 405A in the RAM 405 is stored in the EEPROM 407, which is a non-volatile memory (Step S19).

Figure 7:
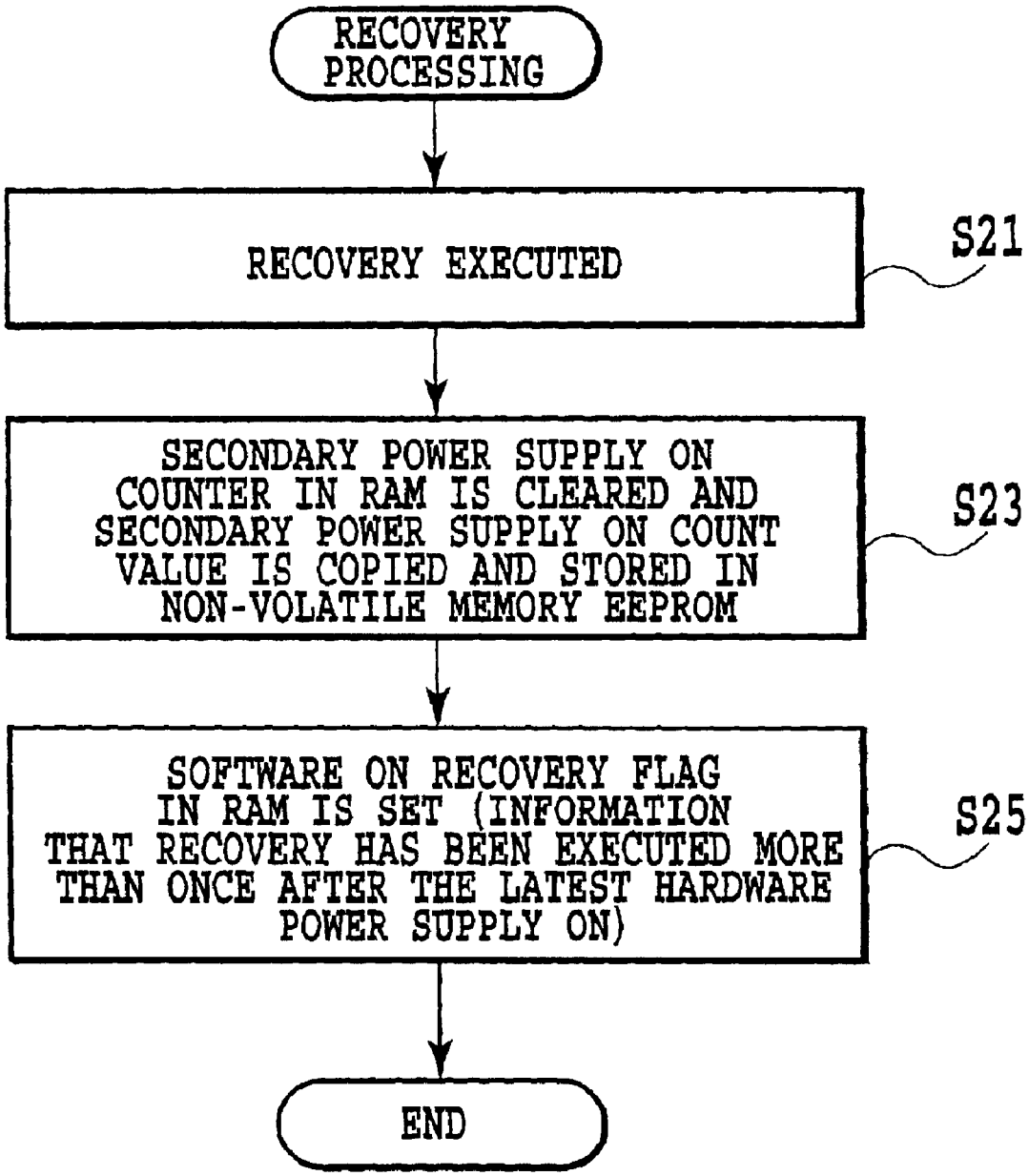
FIG. 7 is a flowchart showing an example of recovery processing procedures of the printing apparatus according to the preferred embodiment of the present invention.

FIG. 7 is an example of the procedure of recovery processing by the apparatus according to the embodiment.

When this procedure is started, the recovery processing is executed by the recovery system 500 (including ink suction through the ejection openings by means of capping onto the ejection opening forming face of the inkjet head and operation of the pump) at Step S21. After that, the secondary power supply ON counter in the RAM 405 is cleared, and the secondary power supply ON count value is copied and retained in the EEPROM 407, which is a non-volatile memory (Step S23). Then the software-power-on recovery flag is set which shows whether the recovery processing has been done one time or more after the latest primary power supply is turned on, and the recovery completed information is set (Step S25). This software-power-on recovery information is saved till the primary power supply is turned off.

The recovery processing procedures in FIG. 7 is activated by the processing in Step S17 in FIG. 6 or may be activated during a series of print operation or at exchange of ink tank, when necessary.

According to the processing of this preferred embodiment, when the secondary power supply is turned on (software-power-on state where the printing apparatus becomes operable) after the primary power supply for physically supplying power source to the apparatus is turned on (hardware-power-on state), only for the first time when it is judged that the count value for counting the number of soft power supply ON without recovery operation of the inkjet head is more than or equal to a predetermined value, the recovery operation is executed. Also, when the recovery operation is executed, the count value is cleared, and the count value is not renewed even if the software power supply is turned off/on till the hard power supply is turned off. This count value is held in the non-volatile memory and its contents is held even after the hard power supply is turned off.

Thus, increase in ink consumption is effectively suppressed through recovery processing of the inkjet head by judging necessity of maintenance processing of the inkjet head when the software power supply is on, based on the maintenance state of the inkjet head before the hardware power supply was off last.

Others

The present invention is applicable not only the inkjet printing method in the above example, but also other print methods, if a printing apparatus is so constructed that the state before the hardware power supply was turned off can be recognized and that operation efficiency of the apparatus and use efficiency of the printing agents can be improved by reflecting the recognition in processing of the software-power-on at this time.

In the case that an inkjet printing method is applied, the present invention achieves distinct effect when applied to a print head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type inkjet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the print head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a print head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the print head, the present invention can achieve printing positively and effectively.

The present invention can be also applied to a so-called full-line type print head whose length equals the maximum length across a printing medium. Such a print head may consists of a plurality of print heads combined together, or one integrally arranged print head.

In addition, the present invention can be applied to various serial type print heads: a print head fixed to the main assembly of a printing apparatus; a conveniently replaceable chip type print head which, when loaded on the main assembly of a printing apparatus, is electrically connected to the main assembly, and is supplied with ink therefrom; and a cartridge type print head integrally including an ink reservoir.

It is further preferable to add a recovery system, or a preliminary auxiliary system for a print head as a constituent of the printing apparatus because they serve to make the effect of the present invention more reliable. Examples of the recovery system are a capping means and a cleaning means for the print head, and a pressure or suction means for the print head. Examples of the preliminary auxiliary system are a preliminary heating means utilizing electrothermal transducers or a combination of other heater elements and the electrothermal transducers, and means for carrying out preliminary ejection of ink independently of the ejection for printing. These systems are effective for reliable printing.

The number and type of print heads to be mounted on a printing apparatus can be also changed. For example, only one print head corresponding to a single color ink, or a plurality of print heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the inkjet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Further, the present invention can be applied to a print system as well as printing apparatus used as an image output terminal of an image data supply apparatus such as computers, scanners, digital cameras. A print system to which the present invention can be applied may be a print system comprising separate plural equipments (host computer, interface apparatus, scanner, printer, etc. for example) or a print system in which a plurality of apparatuses are integrated. The print system in which a plurality of apparatuses are integrated may be a copier integrated with a scanner and a printer, a facsimile machine integrated with a data transmitting/receiving apparatus and a printer, a word processor or electronic typewriter integrally having a printer, a digital camera integrated with a printer. When the present invention is applied to these print systems, at least one of means for turning on/off the secondary power supply, means for counting the number of times when the secondary power supply is turned on and means for maintaining the count value even in the state where the above primary power supply is turned off may be provided on a part other than the body of the printer.

As described in the foregoing, according to the present invention, by recognizing the state before the hardware power supply was turned off last, the recognition is reflected in a software-power-on processing at the present time.

Particularly, in a case that the present invention is applied to an inkjet type printing apparatus for printing on a printing medium by using an inkjet head, ejection quality of the inkjet head is maintained while effectively suppressing increase in ink consumption through recovery processing of the inkjet head, by judging necessity of maintenance processing of the inkjet head when the software power supply is on, based on the maintenance state of the inkjet head before the hardware power supply was off last.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A printing apparatus for performing printing on a printing medium by using a printing head, comprising:

means for turning on/off a secondary power supply to bring said apparatus into a state in which a function is executable after a primary power supply for physically supplying power to said printing apparatus is turned on;

means for tallying a count value, said count value being a number of times that said secondary power supply is turned on;

means for holding said count value even in a state where said primary power supply is turned off;

means for executing recovery processing to improve an ejection condition of ink in said printing head; and means for controlling the execution of the recovery processing according to said count value held by the counting means.

2. A printing apparatus according to claim 1, wherein said holding means has a non-volatile memory.

3. A printing apparatus according to claim 1, wherein said printing head is a printing head for ejecting an ink to print.

4. A printing apparatus according to claim 3, wherein said printing head has an electrothermal transducer to generate a thermal energy for causing film boiling in the ink as an energy used to eject the ink.

5. A printing apparatus according to claim 3, further comprising means for clearing said count value and contents of said holding means when said recovery processing is executed while said secondary power supply is on.

6. A printing apparatus according to claim 5, further comprising means for prohibiting said count until said primary power supply is turned off in the case that said recovery processing is executed while said secondary power supply is on.

7. A printing apparatus according to claim 5, further comprising said recovery means executing said recovery processing when said count value becomes more than or equal to a predetermined value while said secondary power supply is on.

8. A printing apparatus according to claim 5, wherein said recovery means has means for forcedly discharging the ink through an ejection opening for ejecting the ink of said printing head.

9. A printing apparatus according to claim 8, wherein said means for forcedly discharging the ink includes means for suctioning the ink.

10. A printing apparatus for performing printing on a printing medium by using a printing head, wherein said printing head ejects liquid ink to perform printing, said printing apparatus comprising:

recovery means for executing recovery processing to restore an ejection state of the ink from said printing head;

a connection part for supplying power from an external power source to said printing apparatus;

a software switch for switching between a state in which operation of said printing apparatus is enabled and a state in which operation of said printing apparatus is disabled, in a state where external power is supplied to said printing apparatus by said connection part, wherein said software switch switches between the enabled and disabled states without disconnecting the supply of power to said printing apparatus;

counting means for counting the number of times that operation of said printing apparatus is enabled by said software switch;

holding means for holding a count value of said counting means even in a state where power is not supplied to said printing apparatus, whereby a determination can be made of the necessity of executing recovery processing according to said count value of by said counting means; and reset means for resetting the count value held by said holding means to a predetermined value in a case where recovery processing is executed by said recovery means;

wherein said recovery means executes recovery processing when the count value of said counting means becomes more than or equal to a predetermined value while operation of said apparatus is enabled by said software switch.

11. A printing apparatus according to claim 10, wherein said holding means has a non-volatile memory.

12. A printing apparatus according to claim 10, wherein said printing head has an electrothermal transducer to generate a thermal energy for causing film boiling in the ink as an energy used to eject the ink.

13. A printing system wherein a printing apparatus performs printing on a printing medium by using a printing head and an image data supplying apparatus for supplying an image data to be printed to said printing apparatus, said system comprising:

means for turning on/off a secondary power supply to bring said apparatus into a state in which a function is executable after a primary power supply for physically supplying power to said printing apparatus is turned on;

means for tallying a count value, said count value being the number of times that said secondary power supply is turned on;

means for holding said count value even in a state where said primary power supply is turned off;

means for executing recovery processing to improve an ejection condition of ink in said printing head; and means for controlling the execution of the recovery processing according to said count value held by the counting means.

14. A printing system wherein a printing apparatus performs printing on a printing medium by using a printing head and an image data supplying apparatus for supplying an image data to be printed to said printing apparatus, wherein said printing head ejects liquid ink to perform printing, said system comprising:

recovery means for executing recovery processing to restore an ejection state of the ink from said printing head;

a connection part for supplying power from an external power source to said printing apparatus;

a software switch for switching between a state in which operation of said printing apparatus is enabled and a state in which operation of said printing apparatus is disabled, in a state where external power is supplied to said printing apparatus by said connecting part, wherein said software switch switches between the enabled and disabled states without disconnecting the supply of power to said printing apparatus;

counting means for counting the number of times that operation of said printing apparatus is enabled by said software switch; and holding means for holding a count value of said counting means even in a state where power is not supplied to said printing apparatus, whereby a determination can be made of the necessity of executing recovery processing according to said count value of by said counting means; and reset means for resetting the count value held by said holding means to a predetermined value in a case where recovery processing is executed by said recovery means;

wherein said recovery means executes recovery processing when the count value of said counting means becomes more than or equal to a predetermined value while operation of said apparatus is enabled by said software switch.

* * * * *

UNITED STATES PATENT AND TRADEMARK OFFICE

CERTIFICATE OF CORRECTION

PATENT NO. : 6,749,282 B2
DATED : June 15, 2004
INVENTOR(S) : Tetsushi Kohno

It is certified that error appears in the above-identified patent and that said Letters Patent is hereby corrected as shown below:

Column 3,
Line 19, “of f” should read -- off --; and
Line 40, “include” should read -- includes --.

Column 11,
Line 59, “of by” should read -- of --.

Column 12,
Line 55, “of by” should read -- of --.

Signed and Sealed this

Twenty-fifth Day of January, 2005

JON W. DUDAS
*Director of the United States Patent and Trademark Office*